United States Patent [19]

Macaulay

[11] 4,323,212

[45] Apr. 6, 1982

[54] MOUNTING DEVICES

[75] Inventor: John G. Macaulay, Beaconsfield, England

[73] Assignee: Toppy's Salons Limited, London, England

[21] Appl. No.: 135,221

[22] Filed: Mar. 31, 1980

[51] Int. Cl.[3] ..... F16L 3/00

[52] U.S. Cl. ..... 248/51; 248/330.1; 174/48; 211/26

[58] Field of Search ..... 248/51, 52, 317, 314, 248/330.1, 328; 174/69, 48; 211/113, 26

[56] References Cited

U.S. PATENT DOCUMENTS

| | | | |
|---|---|---|---|
| 2,270,997 | 1/1942 | Davis | 248/51 X |
| 2,607,863 | 8/1952 | MacFarland | 174/69 X |
| 2,955,149 | 10/1960 | Gubernick | 174/69 X |
| 3,211,473 | 10/1965 | Schmid | 248/52 X |
| 3,227,802 | 1/1966 | Pressley, Jr. | 174/69 X |
| 3,666,220 | 5/1972 | Rider | 248/52 |
| 3,973,656 | 8/1976 | Zumbro | 248/330.1 X |
| 4,065,084 | 12/1977 | Wiener | 248/314 X |

*Primary Examiner*—Price C. Faw, Jr.
*Assistant Examiner*—Carl D. Friedman
*Attorney, Agent, or Firm*—Norris & Bateman

[57] ABSTRACT

A device for mounting an electrical device such as a hair drier comprises a tube 10, suspension means 11, 12 to suspend the tube from a support with the tube extending downwardly, an extendable electrical lead 14 for the hair drier, the lead being urged into the tube by biasing means 19. The lead can be drawn out of the tube against the action of the bias. There are means such as a hook 20 for releasably attaching the hair drier to the tube so that when the tube is suspended from a support and a hair drier is connected to the lead the hair drier can be unhooked and moved away from the tube when the hair drier is to be used, the lead 14 being drawn out of the tube, and when use of the hair drier is over it can be returned to a storage position by hooking it on to the tube again, the lead returning within the tube.

21 Claims, 5 Drawing Figures

MOUNTING DEVICES

The invention relates to mounting devices.

The invention provides a device for mounting a hair drier or other electrical device, the mounting device comprising an elongate tube, suspension means to suspend the tube from a support, with the tube extending in a downward direction, an extendable electric lead for the electrical device, the lead being urged into the tube by biasing means, but being capable of being withdrawn from the tube against the action of the bias when the lead is extended, and means for releasably attaching the electrical device to the tube, the mounting device being such that when the tube is suspended from a support and an electrical device is connected to the lead, the electrical device can be released from the tube and moved away from the tube when it is to be used, the extendable lead being withdrawn out of the tube against the action of the bias, and when use of the electrical device is over, it can be returned to a storage position by attaching it to the tube again, the lead returning within the tube.

The suspension means may comprise means to suspend the tube from an overhead support rail.

The suspension means may be such that the tube can be moved along the support rail to adjust the position of the mounting device. For example the suspension means may comprise a member attached to the tube, the member having an aperture to receive the support rail.

The aperture may be formed between two interconnected portions of the member, so that the tube can be secured in any desired position along the length of the rail by clamping the rail between the two portions of the member.

The electrical lead may comprise a helical coil of wire extending from one end portion of the tube to the other.

The biasing means may comprise a resilient covering for the wire, tending to retain the wire in its helical form and resist straightening of the wire.

Alternatively, or in addition, a tension spring may be arranged within the tube, the tension spring being attached to the wire so as to retain the wire in its helical form and resist straightening of the wire.

The means for releasably attaching the electrical device to the tube may comprise a support hook.

The support hook is preferably positioned at the end of the tube which is remote from the suspension means.

The mounting device may be arranged to receive and support hair curling tongs as well as a hair drier.

The tube may have a support bracket thereon to support an electrical lead for the hair tongs.

The mounting device may have a holder for the tongs attached to the tube.

The holder may comprise a second tube to receive the tongs, and the longitudinal axes of the tubes may be inclined to one another.

The two tubes may be spaced apart from one another. For example the second tube may be attached to the first mentioned tube by a spacer bar extending radially outwardly of the first mentioned tube.

The second tube may have a spring device therein to grip the tongs when they are inserted into the second tube.

The invention includes a mounting device as hereinbefore defined and having a hair drier and/or hair curling tongs attached thereto.

The invention further includes an overhead support rail having a mounting device as hereinbefore defined suspended therefrom.

By way of example, a specific embodiment of the invention will now be described, with reference to the accompanying drawings, in which.

The mounting device forming the subject of this embodiment is designed for use in a hair dressing salon, to enable a hair drier and hair tongs to be conveniently supported on an overhead support rail so that the drier and tongs are located out of the way when not in use, but are readily accessible.

The mounting device comprises an elongate tube 10 which has a cylindrical metal boss 11 secured to the upper end thereof, with the axis of the boss coinciding with the longitudinal axis of the tube 10. The boss 11 has an aperture therein in the form of a cylindrical bore 12 which passes through the boss with the axis of the bore at right angles to the longitudinal axis of the tube 10. The boss 11 is formed in two halves, 11*a* and 11*b*, clamped together by bolts 13. Thus the tube 10 can be suspended from a cylindrical overhead support rail by disconnecting the halves 11*a* and 11*b* and reassembling them around the support rail, so that the support rail passes through the bore 12. The tube 10 can be locked in any desired position along the length of the rail by tightening the bolts 13 to clamp the rail between the halves 11*a* and 11*b*. If it is desired to move the tube 10 to a new position along the rail, the bolts 13 can be loosened, the tube 10 can be slid along the rail, and the bolts 13 can then be tightened again.

Figure 4:
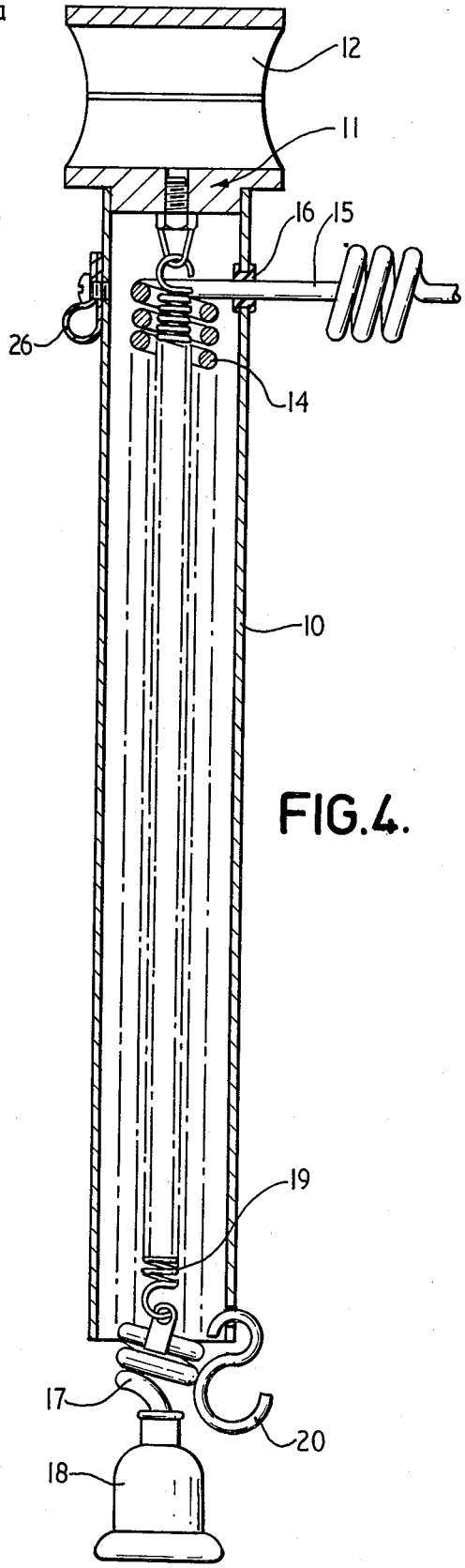
FIG. 4 is a cross-section on line A—A of FIG. 3, showing parts of the device omitted from the other Figures.

As is shown in FIG. 4, an electrical lead 14 is housed within the tube 10. The upper end 15 of the lead 14 passes out through the wall of the tube 10 through a rubber grommet 16, and can be connected to an electrical supply for a hair drier. The other end 17 of the lead has a plug 18 thereon, so that the lead can be plugged into an electrical hair drier (not shown). The lead 17 comprises an insulated helical coil of wire. The coil of wire tends to retain its coiled position within the tube 10 but when a downward pull is applied to the plug 18, the coil straightens and the lead can be extended downwardly out of the tube 10. To assist the tendency of the coil to return to its position within the tube 10, a helical tension spring 19 extends from one end of the lead 14 to the other. The upper end of the spring is secured to the boss 11 and the lower end of the spring is secured to the end 17 of the lead 14.

A support hook 20 for the hair drier is attached to the lower end of the tube 10.

Figure 1:
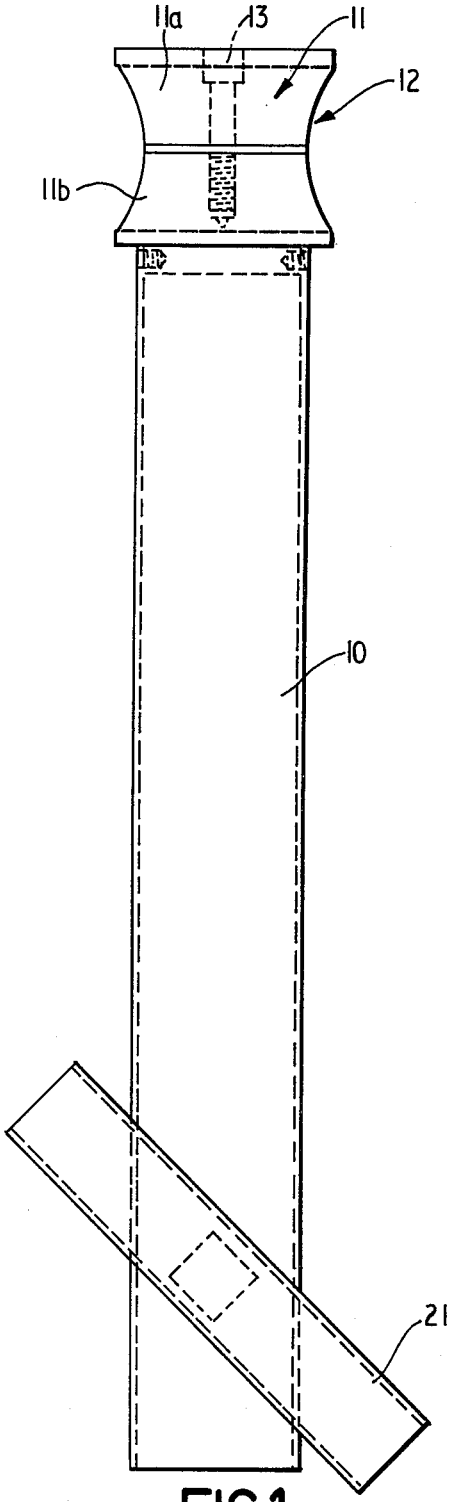
FIG. 1 is a front view of part of a mounting device according to the invention.
Figure 2:
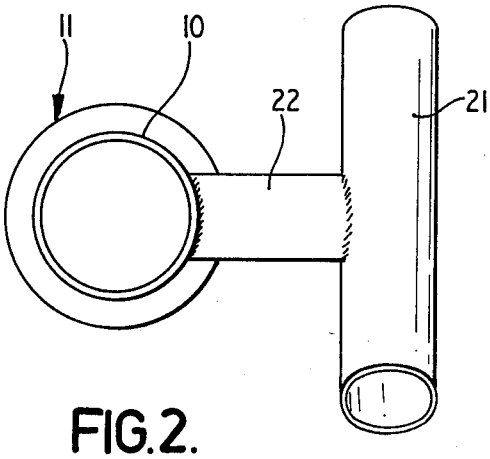
FIG. 2 is an underplan of the device as shown in FIG. 1.
Figure 3:
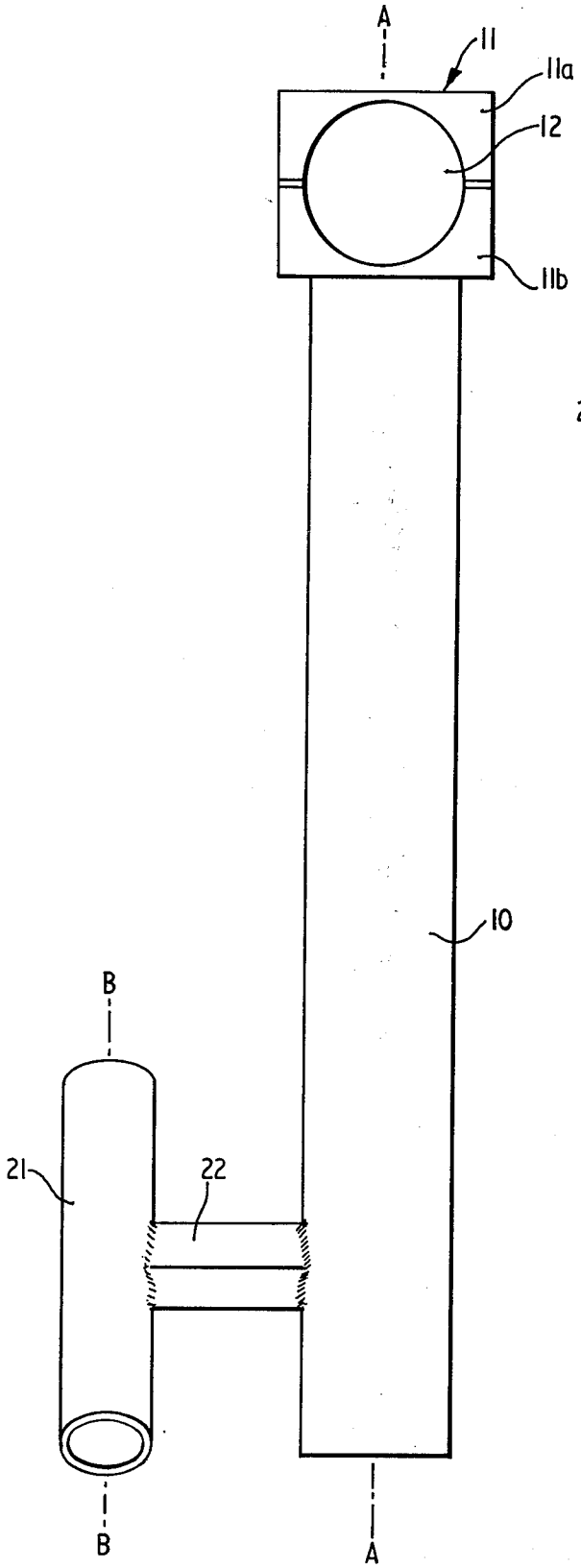
FIG. 3 is a side view of the device shown in FIG. 1.
Figure 5:
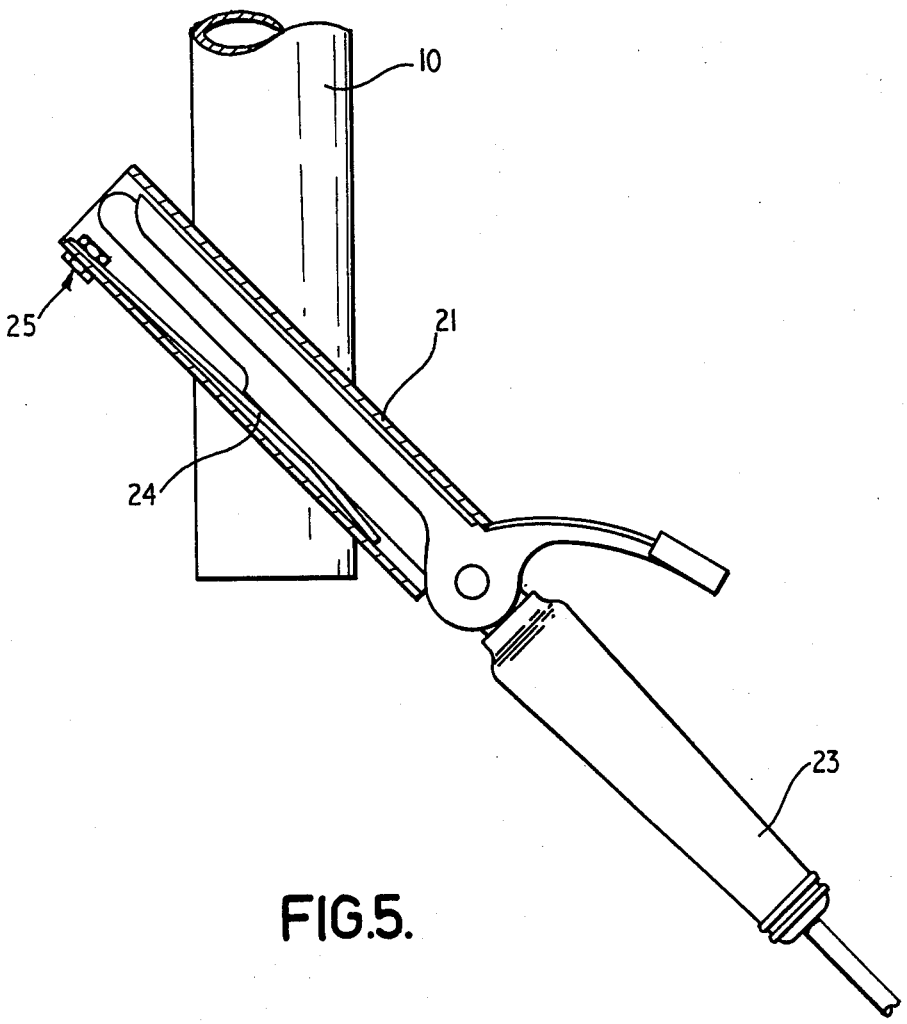
FIG. 5 is a cross-section on line B—B of FIG. 3, showing how the mounting device can be used to receive and support a pair of hair curling tongs.

A second tube 21 is secured to the tube 10 by a short spacer bar 22 welded between the two tubes and extending radially from the tube 10. The tube 21 is shorter than the tube 10 and has a smaller diameter. As best shown in FIGS. 1 and 5, the tube 21 has its longitudinal axis inclined to the longitudinal axis of the tube 10.

The tube 21 is arranged to receive and support a pair of curling tongs 23 as shown in FIG. 5. Within the tube 21 a leaf spring 24 is secured by a nut and bolt assembly 25, so that one end of the tongs 23 can be forced into the tube 21, and the tongs will then remain supported in the tube 21 as a result of the pressure of the spring 24 on the tongs 23.

As shown in FIG. 4, a support bracket 26 is secured to the outer surface of the upper end of the tube 10. This bracket 26 can be used to support an electrical lead for the hair tongs 23.

In use, a hairdressing salon can be provided with a single cylindrical overhead support rail which passes over a number of hair dressing positions. A mounting device as shown in the drawings can be arranged above each hair dressing position to support a hair drier and hair tongs for use by a hair dresser working at that position. When the hair drier is not in use, it can be hooked on to the hook 20, the electrical lead 14 for the hair drier remaining housed within the tube 10. When it is desired to use the hair drier, it is released from the hook 20 and drawn downwardly. The lead 14 extends out of the tube 10 as necessary, and when the hair drier is returned to the hook 20 after use, the lead 14 is returned to the position shown in FIG. 4 by the spring 19.

Similarly the tongs 23 remain housed within the tube 21 when not in use, but they can be readily withdrawn from the tube 21 whenever it is desired to use them.

The invention is not restricted to the details of the foregoing embodiment. For instance the hair drier and the hair tongs could be interchanged, the tube 21 being modified to receive the hair drier or being replaced by some other support for the hair drier, for example a hook. The mounting device according to the invention, whilst specifically described for use in mounting a hair drier, and/or hair curling tongs, could also be used to support one or more other electrical devices.

When it is desired to use the mounting device with a single electrical device, the tube 21 and bracket 26 can be dispensed with.

What we claim is:

1. A device for mounting a hair drier or other electrical device, the mounting device comprising an elongate tube, suspension means to suspend the tube from a support, with the tube extending in a downward direction, an extendable electric lead for the electrical device, the lead being urged into the tube by biasing means, but being capable of being withdrawn from the tube against the action of the bias when the lead is extended, and means for releasably attaching the electrical device to the tube, the mounting device being such that when the tube is suspended from a support and an electrical device is connected to the lead, the electrical device can be released from the tube and moved away from the tube when it is to be used, the extendable lead being drawn out of the tube against the action of the bias, and when use of the electrical device is over, it can be returned to a storage position by attaching it to the tube again, the lead returning within the tube.

2. A device as claimed in claim 1, in which the suspension means comprises means to suspend the tube from an overhead support rail.

3. A device as claimed in claim 2, in which the suspension means is such that the tube can be moved along the support rail to adjust the position of the mounting device.

4. A device as claimed in claim 3, in which the suspension means comprises a member attached to the tube, the member having an aperture to receive the support rail.

5. A device as claimed in claim 4, in which the aperture is formed between two interconnected portions of the member, so that the tube can be secured in any desired position along the length of the rail by clamping the rail between the two portions of the member.

6. A device as claimed in claim 1, in which the electrical lead comprises a helical coil of wire extending from one end portion of the tube to the other.

7. A device as claimed in claim 6, in which the biasing means comprises a resilient covering for the wire, tending to retain the wire in its helical form and resist straightening of the wire.

8. A device as claimed in claim 6 or claim 7, in which there is a tension spring arranged within the tube, the tension spring being attached to the wire so as to retain the wire in its helical form and resist straightening of the wire.

9. A device as claimed in claim 1, in which the means for releasably attaching the electrical device to the tube comprises a support hook.

10. A device as claimed in claim 9, in which the support hook is positioned at the end of the tube which is remote from the suspension means.

11. A device as claimed in claim 1, constructed and arranged to receive and support hair curling tongs as well as a hair drier.

12. A device as claimed in claim 11, in which the tube has a support bracket thereon to support an electrical lead for the hair tongs.

13. A device as claimed in claim 11 or claim 12, in which there is a holder for the tongs attached to the tube.

14. A device as claimed in claim 13, in which the holder comprises a second tube to receive the tongs.

15. A device as claimed in claim 14, in which the longitudinal axes of the two tubes are inclined to one another.

16. A device as claimed in claim 14 or claim 15, in which the two tubes are spaced apart from one another.

17. A device as claimed in claim 16, in which the second tube is attached to the first mentioned tube by a spacer bar extending radially outwardly of the first mentioned tube.

18. A device as claimed in claim 14, in which the second tube has a spring device therein to grip the tongs when they are inserted into the second tube.

19. A mounting device as claimed in claim 11 in combination with hair curling tongs.

20. A mounting device as claimed in claim 1 in combination with a hair drier.

21. An overhead support rail having suspended therefrom a mounting device as claimed in claim 1.

* * * * *